US005704203A

United States Patent [19]

Koltze et al.

[11] Patent Number: 5,704,203

[45] Date of Patent: Jan. 6, 1998

[54] POT-SPINNING MACHINE

[75] Inventors: Karl Koltze, Mönchengladbach; Volker Roland, Weissbach; Peter Voidel, Chemnitz, all of Germany

[73] Assignee: W. Schlafhorst AG & Co., Moenchengladbach, Germany

[21] Appl. No.: 673,620

[22] Filed: Jun. 26, 1996

[30] Foreign Application Priority Data

Jun. 30, 1995 [DE] Germany ..... 195 23 938.5

[51] Int. Cl.[6] ..... D01H 1/08

[52] U.S. Cl. ..... 57/76; 57/77; 57/313; 57/136

[58] Field of Search ..... 57/76, 77, 312, 57/313, 136

[56] References Cited

U.S. PATENT DOCUMENTS

| | | | |
|---|---|---|---|
| 2,232,491 | 2/1941 | Prince-Smith | 57/312 |
| 2,563,053 | 8/1951 | McCann | 57/312 |
| 3,030,761 | 4/1962 | Negishi | 57/76 |
| 3,098,343 | 7/1963 | Negishi | 57/312 |
| 3,111,804 | 11/1963 | Beyer | 57/312 |
| 3,167,901 | 2/1965 | Stetka | 57/312 |

FOREIGN PATENT DOCUMENTS

| | | | |
|---|---|---|---|
| 21 834 | 9/1961 | Germany . | |
| 58 022 | 9/1967 | Germany . | |
| 59 030 | 12/1967 | Germany . | |
| 41 03 771 A1 | 8/1992 | Germany . | |
| 42 06 030 A1 | 9/1993 | Germany . | |
| 42 36 379 A1 | 5/1994 | Germany . | |
| 335049 | 9/1930 | United Kingdom | 57/76 |

*Primary Examiner*—Daniel P. Stodola
*Assistant Examiner*—Tina R. Taylor
*Attorney, Agent, or Firm*—Kennedy Covington Lobdell & Hickman LLP

[57] ABSTRACT

A pot-spinning machine is equipped with a rewinding tube mounted on each yarn guide and with a central, common shogging drive of the yarn guides at one side of the machine. After a yarn break or similar interruption in spinning, in order to be able to initiate the rewinding operation immediately at the affected spinning station while simultaneously continuing the spinning process unchanged at the neighboring spinning stations, the shogging motion of the yarn guide is separated from the motion of the rewinding tube supported on the yarn guide, so that the rewinding tube is then moved only at the forward indexing speed of the yarn guide which is relatively slow compared with the shogging speed and which does not affect the rewinding of yarn onto the rewinding tube.

7 Claims, 1 Drawing Sheet

POT-SPINNING MACHINE

FIELD OF THE INVENTION

The present invention relates to a pot-spinning method and machine, sometimes referred to as can spinning or centrifugal spinning, wherein a plurality of spinning pots are carried on a rail for rotation during yarn spinning and rewinding, a corresponding plurality of tubular yarn guides are carried on a yarn guide rail for imparting simultaneously to the yarn guides, during the spinning process, a shogging motion axially relative to the respective spinning pot and a forward indexing motion superimposed on the shogging motion, and an empty rewinding tube is carried on each yarn guide to be axially displaceable across a mouth of the yarn guide for rewinding onto the tube the yarn cake spun on the inside face of the associated pot.

BACKGROUND OF THE INVENTION

In known pot-spinning machines of the type described above, the rewinding tube, onto which the yarn cake built up inside the spinning pot is to be later transferred, is disposed during the spinning process on the yarn guide such that the rotating yarn segment progressively exiting from the yarn guide mouth and extending therefrom to the yarn cake being wound does not touch the rewinding tube. A base end of the rewinding tube, which is held in readiness near the mouth of the guide tube, can be embodied (preferably by the provision of clamping or retaining devices) such that slight lowering of the tube causes the rotating yarn segment to become fixed or caught across the guide tube, and thus, while the spinning pot continues to rotate about its vertical axis, the yarn cake is wound onto the rewinding tube. The tube can be preferably held in its ready or reserve position on the yarn guide tube with the aid of a magnet or a magnetically displaceable mechanical locking bar. Since the release of the tube must occur very quickly when needed, the distance to be traversed between the reserve and the rewinding position must be kept quite short, for instance only a few millimeters. The rewinding operation can therefore be initiated very quickly, even in an emergency such as in the event of yarn breakage or a power failure.

In East German Patent DD 58 022, a centrifugal or pot-spinning machine is described with upright spinning pots closed at the bottom in which each respective yarn guide is intended to be inserted from above the associated spinning pot. This known spinning machine also has a device for rewinding the yarn cake from the inside surface of the pot onto a rewinding tube disposed on the yarn guide in a reserve position wherein its lower edge is above the mouth of the yarn guide while the yarn cake is being formed, but movable into a rewinding position when necessary or desirable to unwind the yarn cake. During spinning, both the yarn guides and the associated rewinding tubes mounted thereon participate in the motion of the yarn guide rail (column 3, lines 55 et seq). After the buildup of the yarn cake has been completed, the yarn guide rail is stopped (column 4, lines 39 ff.), so that the rewinding tube then to be moved into the rewinding position no longer executes the previously required shogging motion.

A pot-spinning machine with a cylindrical spinning pot that likewise rotates about a vertical axis is also known from East German Patent DD 21 834. This machine has a detent-type locking and tripping device, by means of which each yarn guide and its associated rewinding tube can be decoupled from their control mechanism at the end of the spinning operation, whereby the yarn guide and rewinding tube drop into the spinning pot by their own weight and thus initiate the rewinding operation. Before the lowering of the yarn guide in this known apparatus, the mounted rewinding tube is thrust forwardly from the yarn guide sufficiently that its lower end protrudes past the yarn exit mouth of the yarn guide so that the yarn cake begins to rewind from the inside circumference of the spinning pot onto the rewinding tube when the yarn guide and rewinding tube drop.

East German Patent DD 59 030 discloses another apparatus for rewinding completed yarn cakes wherein the yarn cake is also rewound onto rewinding tubes. The rewinding tubes are held in readiness on yarn guides located on a yarn guide rail supported to be movable up and down in alternation to build up the yarn cake (column 3, lines 46 et seq.). Each rewinding tube is mounted on an associated yarn guide by two pivoting locking bars, one of which holds the associated rewinding tube during the buildup of the yarn cake and the other of which fixes the rewinding tube during rewinding of the yarn cake in a lowered position in which they remain until being doffed from the yarn guides.

Another apparatus for producing a yarn by the above-described centrifugal spinning method utilizing a shogging yarn guide is described in German Patent Disclosure DE 41 03 771 A1. The essential thrust of this reference is the buildup of the yarn cake. However, it is also stated that a spinning pot open at the top has the advantage that the rewinding tube can be mounted from above onto the yarn guide inserted into the spinning pot before spinning begins (column 4, lines 28 et seq.).

According to German Patent Disclosure DE 42 36 379 A1, there are pot-spinning machines that are designed such that all the spinning pots are rotated by one common drive mechanism, and all the yarn guides (of one side of the machine) are likewise raised and lowered by a spinning rail as one common drive mechanism. Because of its decisively lower investment cost and the substantially reduced vulnerability to malfunction, such common drives are preferred over the use of a single drive for each spinning pot that is also technically feasible.

This known central drive for one entire side of a machine may, however, also have disadvantages. For instance, after a yarn break, a yarn segment typically still rotates for a short time between the yarn guide mouth and the yarn cake and can be used to initiate an emergency rewinding operation. Thus, in order to reach this rotating yarn segment, the rewinding tube must be immediately moved into the rewinding position. However, an uncontrolled, unintended rewinding of the spinning cake onto the yarn guide tube must also be avoided. In order to be able to move the rewinding tube into the rewinding position as quickly as possible when needed, it is expedient to position the rewinding tube in a known manner on the yarn guide tube and to fix it in a special tube mount.

After a yarn break, if the rewinding tube disposed on and coupled with the yarn guide is then lowered into the region of the rotating yarn segment, an emergency rewinding operation onto this rewinding tube begins. However, the rewinding tube also continues the shogging motion of the yarn guide unchanged since the yarn guide rail that drives each yarn guide must naturally not be stopped because the shogging motion is absolutely necessary at the other spinning stations so that spinning can be continued. The shogging motion superimposed on the emergency rewinding operation, however, causes an irregular bobbin buildup on the rewinding tube, which in turn causes considerable problems in later rewinding in an automatic bobbin winder and thus makes the bobbin obtained from the aforementioned emergency rewinding practically worthless.

OBJECT AND SUMMARY OF THE INVENTION

With the above-described prior apparatus as background, it is accordingly an object of the present invention to provide a pot spinning apparatus and method which, in the event of a yarn break or other failure of one or more spinning stations of a pot-spinning machine, enables emergency yarn rewinding to be effectively accomplished without impeding or affecting the normal spinning process at the other spinning stations; that is, continued unaltered shogging operation of the yarn guides in the other spinning stations is assured.

The present invention basically resides in a pot-spinning machine and method of the type above-described in which all yarn guide tubes at one side of the machine are disposed on a common yarn guide rail to jointly execute a shogging motion on which a forward indexing motion is superimposed and, briefly summarized, the present invention contemplates that, at least during the rewinding operation and preferably throughout the spinning operation as well, the rewinding tube is decoupled from the shogging drive of the yarn guide rail.

For the success of the invention it is essential that at least from the moment at which an emergency rewinding operation begins (whether caused for instance by a yarn break, power failure, or other fault in the affected spinning station), the rewinding tube no longer executes the shogging or reversing motion that was theretofore essential for the success of the actual spinning operation. Conversely, the forward indexing motion superimposed on the shogging motion during spinning is not a hindrance in the rewinding operation because it is extraordinarily slow, the speed being for instance on the order of 10 to 15 cm. per hour, and because the rewinding operation lasts only a few seconds. On the other hand, it is favorable to cause the rewinding tube to track the progressive motion of the yarn guide, because then the displacement path of the rewinding tube from the reserve position to the rewinding position is always constant and short.

According to a further feature of the invention, a rewinding tube mount, such as a common tube supporting rail, is coupled to a drive mechanism that is common to one side of the machine but is separate from the shogging motion of the yarn guides or yarn guide tubes. This drive mechanism specifies the forward indexing motion, preferably simultaneously for or effected by the yarn guides or the yarn guide rail. As a result, after the lowering of each rewinding tube necessary for initiating a rewinding operation in the event of a yarn break or the like, the tube is then acted upon only with the much slower forward indexing motion, compared with the shogging speed, which motion does not impair the rewinding of yarn onto the rewinding tube to produce a bobbin. The rewound tubes of yarn thus produced are easily rewindable without additional waste in an automatic bobbin winder subsequent to the yarn production process.

According to a preferred embodiment of the invention, the methodology for operating a pot-spinning machine of the above-described type, in which after a yarn break or similar interruption in the spinning process the rewinding operation is initiated at the affected work station while at the same time the spinning process is continued at the neighboring work stations, is improved according to the present invention by separation of the shogging motion of the yarn guide from the motion of the rewinding tube supported on the yarn guide, at least during the rewinding operation.

Further details and features of the invention will become apparent from an exemplary embodiment described below in conjunction with the drawings.

DESCRIPTION OF THE PREFERRED EMBODIMENT

Figure 1:
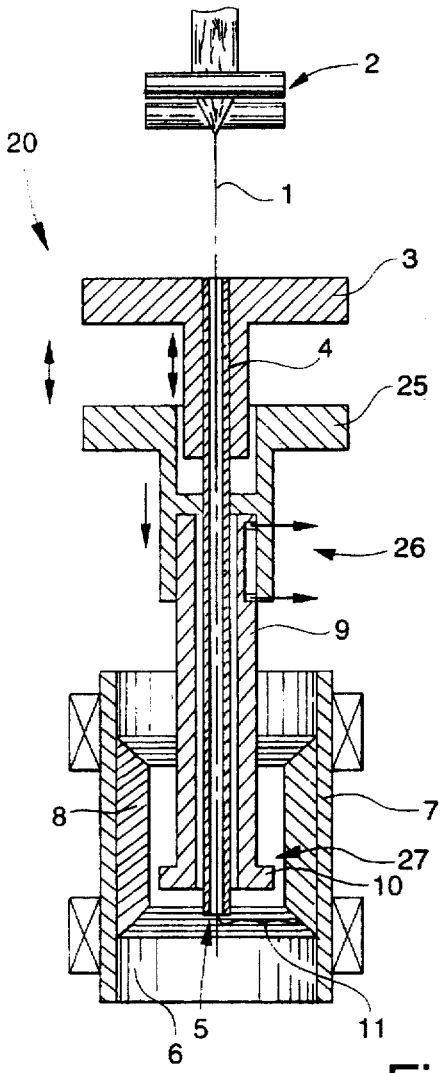
FIG. 1 is a schematic vertical cross-section through a spinning station of a pot-spinning machine in accordance with the preferred embodiment of the present invention, depicting the normal spinning operation.

FIG. 1 schematically shows one spinning station, identified overall by reference numeral 20, of a multi-station pot-spinning machine in accordance with the present invention. In a known manner, such spinning stations 20 have a sliver drawing device, in the present case a drafting mechanism 2. The fiber material drawn in the drafting mechanism 2 is guided via a tubular yarn guide 4 into the interior of a spinning pot 7, in which the fiber material is spun into a yarn 1 under the influence of the rotating spinning pot 7 and is temporarily stored in the form of a yarn cake 8 formed on the inner wall 6 of the spinning pot 7.

The yarn 1 emerging from the lower exit mouth 5 of the yarn guide 4 is applied to the yarn cake 8 centrifugally via a substantially radially extending yarn segment 11 rotating in the same direction as the spinning pot.

The yarn guides 4 associated with the plural spinning stations at one side of the machine are fixedly disposed on a common so-called yarn guide rail 3, which is movable vertically via a suitable drive mechanism (not shown), as described below such that all the yarn guides 4 at one side of the machine always follow the same course of motion specified by the yarn guide rail 3.

During the spinning process, the yarn guide rail is shogged continuously in the vertical direction (as diagrammatically represented by the curve 21 in FIG. 3) by the aforementioned drive mechanism. The yarn guide rail 3 is also subjected to a forward indexing motion (as similarly represented diagrammatically by the lines 22 or 23 in FIG. 3), producing a constant, gradual lowering motion of the yarn guide rail 3 which may extend linearly, as indicated by the curve 22 in FIG. 3, or in a stepwise fashion, as indicated by the curve 23 of FIG. 3. Since the shogging motion 21 and the forward indexing motion 22 or 23 are superimposed on one another, the yarn guide rail 3 in the final analysis has the collective course of motion represented by the curve 24 in the graph of FIG. 3.

Figure 3:
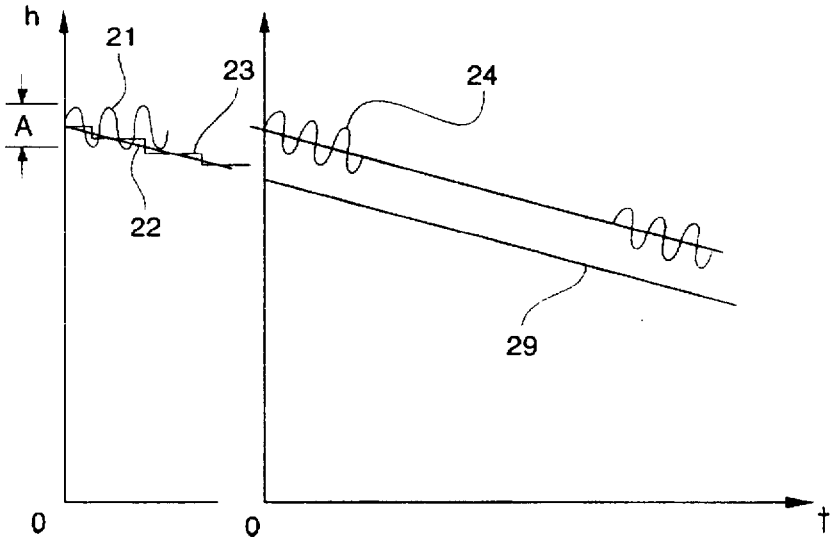
FIG. 3 is a graph showing the courses of motion of the yarn guide rail and of the rewinding tube holding device in the operation of the spinning station of FIG. 1, plotted as distance of movement against elapsed time over the course of a spinning operation.

In the distance and time graph of FIG. 3, the heightwise position of the yarn guide rail is plotted on the ordinate and the time elapsed over the course of a spinning operation is plotted on the abscissa. In terms of order of magnitude, the frequency of the shogging motion 21 is from 0.04 to 0.2 Hz, while the time required to fully spin a typical spinning pot may be on the order of magnitude of approximately 10 minutes to 2 hours. The amplitude A of the shogging motion (curve 21 or 24) is approximately 10 to 30 mm. These dimensional indications are within the typical scope for conventional machines of this type.

Figure 2:
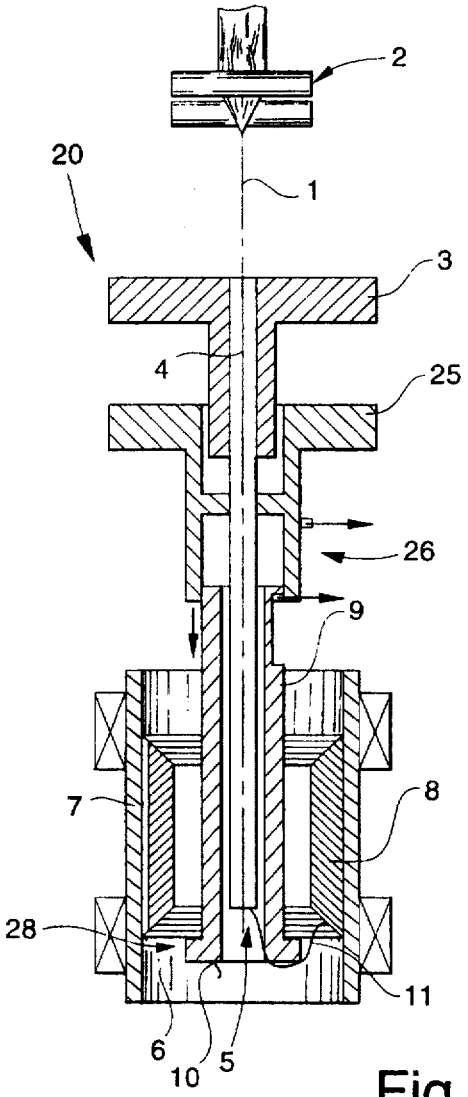
FIG. 2 is another schematic vertical cross-section of the spinning station of FIG. 1, showing the beginning of a rewinding operation.

As shown in FIGS. 1 and 2, a rewinding tube 9 is disposed concentrically to each yarn guides 4. According to the present invention, the rewinding tubes 9 are supported independently of the yarn guides 4 on their own, separate tube rail 25, which has gripping means 26 for grasping each rewinding tube 9.

The tube rail 25 is arranged such that, during the spinning process, the lower ends 10 of the rewinding tubes 9 are always positioned above the exit mouths 5 of the yarn guides 4 by a predetermined distance, which must be somewhat larger than the amplitude of the shogging motion of the yarn guide rail 3. The tube rail 25 has its own drive mechanism (not shown), by which the tube rail 25 tracks the forward indexing motion 22 or 23 of the tube rail 25 during the spinning process, as signified in FIG. 3 by line 29.

Thus, during the spinning process, each rewinding tube 9 is always kept at a relatively small distance above the yarn guide mouth 5 in a readiness position 27 that follows the forward indexing motion, but the tube rail 25 does not follow along with the shogging motion 21 of the yarn guide rail 3.

If for whatever reason (e.g. a yarn break) a single spinning station among the plural spinning stations of the spinning machine is to be stopped, then it is desirable for the yarn cake 8 already produced in the pot 7 to be rescued and wound onto the rewinding tube 9 associated with the yarn guide 4 of such spinning station. Winding the spinning cake 8 onto the rewinding tube 9 is also advantageous because otherwise there is the danger that the yarn cake will be wound automatically onto the yarn guide 4.

If such an emergency occurs, for instance in the event of a yarn break, then the rewinding tube 9, as represented in FIG. 2, is lowered as quickly as possible into a rewinding position 28 inside the spinning pot 7 wherein the lower end edge 10 of the rewinding tube 9 projects beyond the yarn guide 4 and can engage and grasp the rotating yarn segment 11 so that the rewinding of the yarn cake 8 onto the bobbin tube 9 can begin.

Since the rewinding tube 9, at least in this rewinding position 28, does not follow the shogging motion of the yarn guide rail 3, a satisfactory yarn buildup on the rewinding tube 9 is assured during the rewinding process.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a pot-spinning machine having a plurality of rotatable spinning pots, a corresponding plurality of elongate hollow yarn guides for delivering respective yarn strands into the spinning pots for centrifugal formation of yarn cakes therein, said yarn guides being driven into motion, the motion being a shogging motion axially relative to an axis about which the spinning pots revolve and a simultaneous forward indexing motion, and a yarn guide rail for carrying the yarn guides and imparting the motion collectively thereto, the improvement comprising:

a corresponding plurality of rewinding tubes; and means for supporting said rewinding tubes in a coaxial disposition with the yarn guides, with said rewinding tubes being axially movable independently of the yarn guides for selective displacement relative to the yarn guides for rewinding a yarn cake formed inside the spinning pots, said means for supporting said rewinding tubes being driven correspondly to and independently from the yarn guide rail for execution of the forward indexing motion simultaneously with the yarn guides, and absent the shogging motion of the yarn guides during rewinding to prevent said rewinding tubes from undergoing the shogging motion.

2. An improved pot-spinning machine according to claim 1, wherein the rewinding tube supporting means is operative to track the indexing movements at a generally equal speed thereto.

3. An improved pot-spinning machine according to claim 1 wherein said means for supporting said rewinding tubes includes a tube rail to which said rewinding tubes are mounted, said tube rail forming a movement mechanism common to one side of the machine and movable independently of the yarn guide during rewinding to prevent said rewinding tubes from undergoing the shogging motion during rewinding.

4. An improved pot-spinning machine according to claim 1 wherein said means for supporting said rewinding tubes is driven corresponding to and independently from the yarn guide rail for execution of the forward indexing motion simultaneously with the yarn guides, and absent the shogging motion of the yarn guides during spinning to prevent said rewinding tubes from undergoing the shogging motion during spinning.

5. A method of pot-spinning yarns comprising the steps of delivering a plurality of yarns through a corresponding plurality of tubular yarn guides into a plurality of spinning pots for centrifugal formation of yarn cakes therein, simultaneously imparting to the yarn guides a shogging motion axially relative to the spinning pots and a forward indexing motion superimposed on the shogging motion, supporting a corresponding plurality of rewinding tubes for rewinding of the yarn cakes thereonto from the spinning pots, such that the rewinding tubes are driven correspondingly and independently from the yarn guides each rewinding tube being supported for axial displacement relative to a respective yarn guide to initiate a yarn rewinding operation, the rewinding tubes being supported independently of the shogging motion of the yarn guides for preventing the yarn guides from undergoing the shogging motion during the yarn rewinding operation.

6. The method of claim 5, and comprising further the step of supporting the rewinding tubes to track the progressive buildup of the yarn cake generally at the indexing speed of the yarn guide.

7. A method for operating the pot-spinning machine according to claim 5, wherein the shogging motion of the yarn guide is separated from the motion of said rewinding tube supported on the yarn guide.

* * * * *